US008671819B2

(12) United States Patent
Dunne, Jr. et al.

(10) Patent No.: US 8,671,819 B2
(45) **Date of Patent: *Mar. 18, 2014**

(54) BLAST LOAD ATTENUATION SYSTEM FOR A VEHICLE

(71) Applicant: The Boeing Company, Chicago, IL (US)

(72) Inventors: John C. Dunne, Jr., Costa Mesa, CA (US); Jonathan W. Gabrys, Downingtown, PA (US); Timothy J. Lee, Mount Laurel, NJ (US); Alexander M. Boyer, Chadds Ford, PA (US); Jon C. Charland, Long Beach, CA (US); Larry Jepson, Slidell, LA (US)

(73) Assignee: The Boeing Company, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/802,711
(22) Filed: Mar. 14, 2013
(65) Prior Publication Data

US 2014/0026741 A1 Jan. 30, 2014

Related U.S. Application Data

(62) Division of application No. 12/414,509, filed on Mar. 30, 2009, now Pat. No. 8,418,594.

(51) Int. Cl.
*F41H 5/02* (2006.01)

(52) U.S. Cl.
USPC ..... 89/36.02; 89/904; 89/929; 89/36.07; 428/911

(58) Field of Classification Search
USPC ..... 89/36.02–36.12; 428/911; 109/49.5
See application file for complete search history.

(56) References Cited

U.S. PATENT DOCUMENTS

| | | | | |
|---|---|---|---|---|
| 3,071,853 | A | 1/1963 | Price et al. | |
| 3,072,225 | A | 1/1963 | Cremer et al. | |
| 4,248,342 | A | 2/1981 | King et al. | |
| 4,325,309 | A | 4/1982 | King et al. | |
| 4,404,889 | A | 9/1983 | Miguel | |
| 4,589,341 | A | 5/1986 | Clark et al. | |
| 5,679,918 | A | 10/1997 | Korpi et al. | |
| 6,805,035 | B2 | 10/2004 | Edberg et al. | |
| 6,825,137 | B2 | 11/2004 | Fu et al. | |
| 6,901,839 | B2 | 6/2005 | Edberg et al. | |
| 6,964,219 | B2 | 11/2005 | Gilon | |
| 7,114,764 | B1 | 10/2006 | Barsoum et al. | |
| 7,270,045 | B1 | 9/2007 | Gonzalez | |
| 7,601,654 | B2 | 10/2009 | Bhatnagar et al. | |
| 7,631,589 | B2 | 12/2009 | Hunn et al. | |
| 7,997,182 | B1 | 8/2011 | Cox | |
| 8,205,703 | B2 | 6/2012 | Halliday | |
| 8,418,594 | B1 * | 4/2013 | Dunne et al. | 89/36.02 |
| 2009/0272254 | A1 | 11/2009 | Hunn et al. | |
| 2011/0197744 | A1 | 8/2011 | Cox | |

OTHER PUBLICATIONS

Gabrys et al., "Blast Attenuation System," U.S. Appl. No. 12/414,509, filed Mar. 30, 2009, 61 pages.

"Plasan Sasa Unveils Blast and Mine Protection System," Defense Update, copyright 2007, 2 pages. Retrieved Mar. 11, 2009 from http://defense-update.com/newscast/0307/news/070307_plasan.htm.

Office Action, dated Jul. 24, 2012, regarding U.S. Appl. No. 12/414,509, 14 pages.

Notice of Allowance, dated Dec. 13, 2012, regarding U.S. Appl. No. 12/414,509, 7 pages.

Notice of Allowance, dated Dec. 28, 2012, regarding U.S. Appl. No. 12/414,509, 4 pages.

* cited by examiner

*Primary Examiner* — Michael David
(74) *Attorney, Agent, or Firm* — Yee & Associates, P.C.

(57) ABSTRACT

An apparatus may comprise an outer skin having an exterior side and an interior side, an internal structure positioned relative to the interior side of the outer skin, and an inner skin. The internal structure may be capable of absorbing a blast load applied to the exterior side of the outer skin. The internal structure may be located between the outer skin and the inner skin.

20 Claims, 14 Drawing Sheets

BLAST LOAD ATTENUATION SYSTEM FOR A VEHICLE

This application is a divisional of application Ser. No. 12/414,509, filed Mar. 30, 2009, status pending.

BACKGROUND INFORMATION

1. Field

The present disclosure relates generally to a structure and, in particular, a structure that may be used to protect an interior volume from an explosive blast. Still more particularly, the present disclosure relates to a blast attenuation system that may attenuate loads generated by a blast occurring under a vehicle.

2. Background

Improvised explosive devices may be bombs fabricated in an improvised manner. These devices may incorporate explosive materials, as well as fragmentation materials. Improvised explosive devices may be remote controlled and/or triggered by infrared detectors, pressure bars, trip wires, and/or other suitable devices. Mines may be explosive devices placed on or in the ground. When in the ground, these mines may be referred to as land mines. These types of mines may be triggered by an operator and/or the proximity of a vehicle, person, animal, and/or some other suitable object. Improvised explosive devices may include both improvised explosive devices as well as land mines.

Improvised explosive devices and/or land mines may target the sides of vehicles and armored vehicles. For example, without limitation, the underside of a vehicle may be targeted by improvised explosive devices.

Various counter-measures may be employed to reduce and/or eliminate threats from improvised explosive devices. Some counter-measures include electronic jamming devices that may prevent the ignition of improvised explosive devices that may be remote controlled through electronic triggers. These electronic counter-measures, however, may be ineffective against improvised explosive devices that may use trip wires or other non-wireless trigger mechanisms, such as pressure switches used in land mines.

Other counter measures also may include detecting improvised explosive devices. For example, chemical signatures of unknown substances may be detected using various systems such as, for example, without limitation, a stoichiometric diagnostic device.

Although these and other counter measures may be useful in preventing the triggering of improvised explosive devices and/or detecting improvised explosive devices, improvised explosive devices may still be set off even with these precautions.

As a result, structures may be employed on the underside of vehicles to protect against pressures and/or loads that may occur when an improvised explosive device explodes. These structures may take the form of blast plates. These blast plates may reduce and/or eliminate the effects of the explosive pressure and/or fragments to the occupants of a vehicle. These blast plates may include using armor similar to those on the sides of armored personnel carriers and tanks. These types of blast plates may be helpful in reducing and/or preventing injury to occupants of a vehicle.

The use of these blast plates, however, may add to the weight of a vehicle. The weight may reduce the fuel efficiency of a vehicle and increase operating costs. Further, the weight of currently used blast plates also may increase the strain on other components of the vehicle resulting in more frequent maintenance being needed. Additionally, the weight of blast plates may reduce the ability of the vehicle to be transported by airplanes and/or helicopters. The weight of the blast plates also may reduce the acceleration, maneuverability, and/or performance of the vehicle during travel.

Therefore, it would be advantageous to have a method and apparatus that takes into account one or more of these issues, as well as possibly other issues.

SUMMARY

In one advantageous embodiment, an apparatus may comprise an outer skin having an exterior side and an interior side, an internal structure positioned relative to the interior side of the outer skin, and an inner skin. The internal structure may be capable of absorbing energy applied to the exterior side of the outer skin. The internal structure may be located between the outer skin and the inner skin.

In another advantageous embodiment, a blast attenuation environment may comprise a blast plate, an internal structure, and an inner skin. The blast plate may have an exterior side and an interior side and may have a curved shape. The internal structure may be positioned relative to the interior side. The internal structure may be capable of absorbing energy applied to the exterior side of the blast plate. Further, the internal structure may comprise at least one of a foam material and a honeycomb material and a plurality of deformable members selected from at least one of a number of bulkheads. Each of the plurality of deformable members may have a shape selected from one of a curved shape and a double curved shape. The inner skin may form a floor of a vehicle and may comprise a floor stiffener panel and an energy absorbing floor layer. The internal structure may be located between the blast plate and the inner skin. The internal structure may be connected to a frame system of the vehicle.

In yet another advantageous embodiment, an apparatus may comprise a blast plate having a curved shape.

In still yet another advantageous embodiment, a vehicle may comprise a blast plate having a curved shape, an internal structure positioned relative to an interior side of the blast plate, and an inner skin. The blast plate may be connected to the vehicle. The curved shape may be selected from one of a partial cylinder and a partial dome. The internal structure may be capable of absorbing energy applied to an exterior side of the blast plate. The internal structure may comprise a number of longitudinal bulkheads and a number of lateral bulkheads and at least one of a foam material and a honeycomb material. Further, the internal structure may be connected to the vehicle and may be located between the blast plate and the inner skin.

In another advantageous embodiment, a method may be present for installing a blast attenuation system. The blast attenuation system may be positioned relative to a vehicle. The blast attenuation system may comprise a blast plate having an exterior side and an interior side, an internal structure positioned relative to the interior side, and an inner skin. The internal structure may be capable of absorbing energy applied to the exterior side of the blast plate. The blast attenuation system may be attached to the vehicle.

In yet another advantageous embodiment, a method may be present for attenuating a blast load in a vehicle. A blast load is applied to a vehicle. The blast load applied to the vehicle may be attenuated with a blast attenuation system for the vehicle. The blast attenuation system may comprise a blast plate having an exterior side and an interior side and an internal structure positioned relative to the interior side. The internal structure may be capable of absorbing energy applied to the exterior side of the blast plate.

In still yet another advantageous embodiment, a method may be present for manufacturing a blast plate. A model for the blast plate may be created. The model may include a curved shape for the blast plate. A number of simulations may be run on the model created for the blast plate to generate a number of results. A determination may be made as to whether the number of results meets a design specification for the blast plate. In response to the model meeting the design specification, the blast plate may be manufactured using the model.

In yet another advantageous embodiment, a method may be present for manufacturing a blast plate. A model for the blast plate may be created. The model may include a curved shape and a number of materials for the blast plate. A number of simulations may be run on the model created for the blast plate to generate a number of results. A determination may be made as to whether the number of results meets a design specification for the blast plate. In response to the model meeting the design specification, the blast plate may be manufactured using the model. The curved shape for the model may be changed to form a new model in response to an absence of the number of results meeting the design specification. The number of simulations may be run on the new model. The steps of changing the model to form the new model in response to the absence of the number of results meeting the design specification and running the number of simulations on the new model may be repeated until the new model meets the design specification. In response to the new model meeting the design specification, the blast plate may be manufactured using the new model.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the advantageous embodiments are set forth in the appended claims. The advantageous embodiments, however, as well as a preferred mode of use, further objectives and advantages thereof, will best be understood by reference to the following detailed description of an advantageous embodiment of the present disclosure when read in conjunction with the accompanying drawings, wherein:

DETAILED DESCRIPTION

Figure 1:
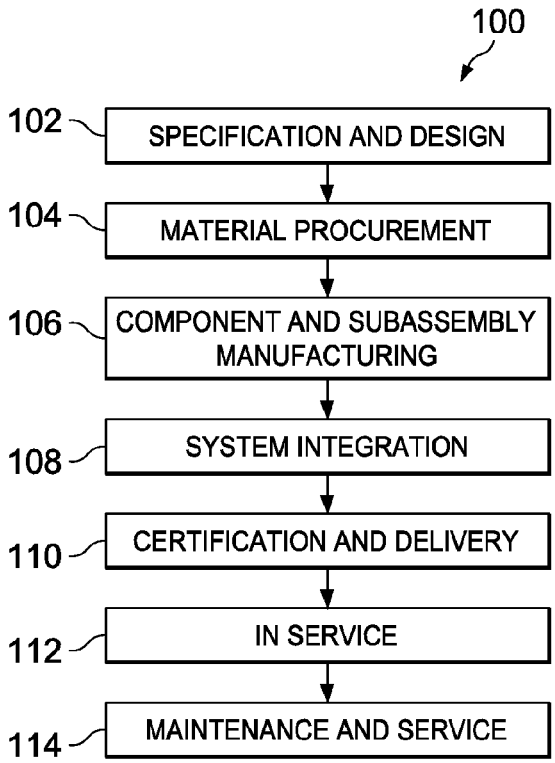
FIG. 1 is an illustration of a ground vehicle manufacturing and service method in accordance with an advantageous embodiment.
Figure 2:
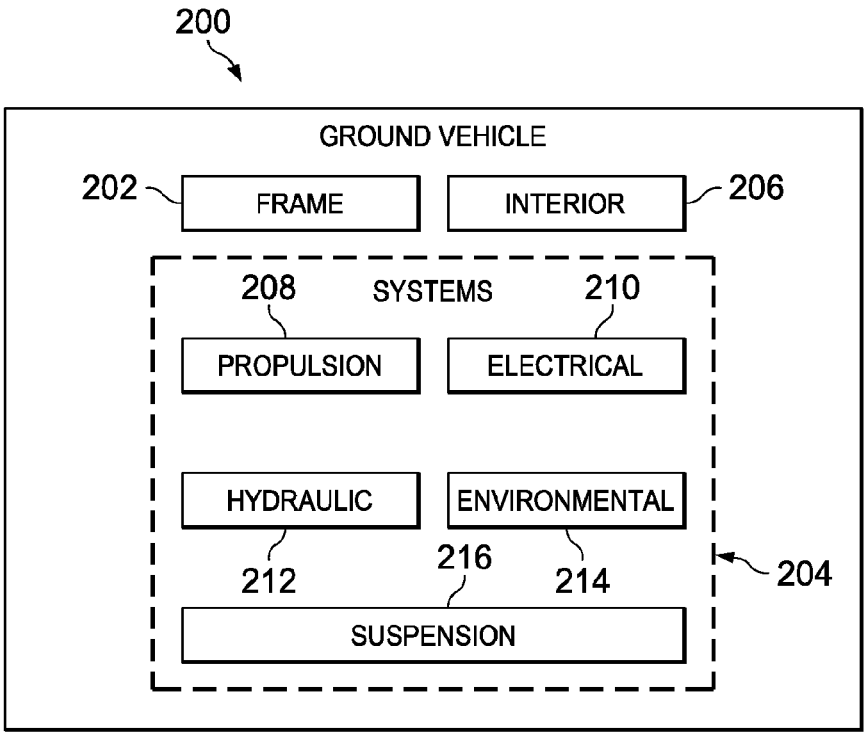
FIG. 2 is an illustration of a ground vehicle in which an advantageous embodiment may be implemented.

Referring more particularly to the drawings, embodiments of the disclosure may be described in the context of ground vehicle manufacturing and service method 100 as shown in FIG. 1 and ground vehicle 200 as shown in FIG. 2. Turning first to FIG. 1, an illustration of a ground vehicle manufacturing and service method is depicted in accordance with an advantageous embodiment. During pre-production, exemplary ground vehicle manufacturing and service method 100 may include specification and design 102 of ground vehicle 200 in FIG. 2 and material procurement 104.

During production, component and subassembly manufacturing 106 and system integration 108 of ground vehicle 200 in FIG. 2 may take place. Thereafter, ground vehicle 200 in FIG. 2 may go through certification and delivery 110 in order to be placed in service 112. While in service by a customer, ground vehicle 200 in FIG. 2 may be scheduled for routine maintenance and service 114, which may include modification, reconfiguration, refurbishment, and other maintenance or service.

Each of the processes of ground vehicle manufacturing and service method 100 may be performed or carried out by a system integrator, a third party, and/or an operator. In these examples, the operator may be a customer. For the purposes of this description, a system integrator may include, without limitation, any number of ground vehicle manufacturers and major-system subcontractors; a third party may include, without limitation, any number of vendors, subcontractors, and suppliers; and an operator may be a leasing company, military entity, service organization, and so on.

With reference now to FIG. 2, an illustration of a ground vehicle is depicted in which an advantageous embodiment may be implemented. In this illustrative example, ground vehicle 200 may be produced using manufacturing and service method 100 in FIG. 1 and may include frame 202 with plurality of systems 204 and interior 206. Examples of systems 204 may include one or more of propulsion system 208, electrical system 210, hydraulic system 212, blast attenuation system 214, suspension system 216, and/or any other suitable type of system. Any number of other systems may be included.

In these illustrative examples, ground vehicle 200 may take various forms. For example, without limitation, ground vehicle 200 may be a high mobility multi-purpose ground vehicle, a tank, an armored personnel carrier, a car, a truck, or some other suitable type of ground vehicle. Although a ground vehicle is shown, different advantageous embodiments may be applied to other industries, such as naval or ship building industries.

Apparatus and methods embodied herein may be employed during any one or more of the stages of vehicle manufacturing and service method 100 in FIG. 1. For example, components or subassemblies produced in component and subassembly manufacturing 106 in FIG. 1 may be fabricated or manufactured in a manner similar to components or subassemblies produced while ground vehicle 200 is in service 112 in FIG. 1.

Also, one or more apparatus embodiments, method embodiments, or a combination thereof may be utilized during production stages, such as component and subassembly manufacturing 106 and system integration 108 in FIG. 1, for example, without limitation, by substantially expediting the assembly of or reducing the cost of ground vehicle 200. Similarly, one or more apparatus embodiments, method embodiments, or a combination thereof may be utilized while ground vehicle 200 is in service or during maintenance and service 114 in FIG. 1.

As a specific example, some advantageous embodiments may be implemented during component and subassembly manufacturing 106 to integrate blast attenuation system 214 into ground vehicle 200. In other advantageous embodiments, blast attenuation system 214 may be implemented in ground vehicle 200 during maintenance and service 114. In yet other advantageous embodiments, maintenance on blast attenuation system 214 may be performed during maintenance and service 114.

The different advantageous embodiments recognize and take into account a number of different considerations. For example, the different advantageous embodiments recognize and take into account that traditional blast attenuation systems may rely on a thick steel plate that may be in a V-shape or a planar or flat shape to deflect damaging pressure loads and/or other loads. These pressure loads may occur from explosions, such as an improvised explosive device or a mine being set off.

The different advantageous embodiments recognize that although these types of currently available blast plates may be suitable for reducing and/or eliminating the effects of a blast into an interior of a vehicle, these systems may increase the weight of the vehicle in a manner that may reduce other types of performance. For example, without limitation, the increased weight may result in a need for increased maintenance for the vehicle, increased fuel costs, decreased acceleration, decreased maneuverability, decreased performance, decreased availability for air transport, and/or other undesirable changes.

Thus, the different advantageous embodiments provide a method and apparatus for attenuating the load that may be applied by a blast. In one advantageous embodiment, a blast plate may have an exterior side and an interior side. The apparatus also may have an internal structure positioned relative to the interior side in which the internal structure is capable of absorbing energy applied to the exterior side of the blast plate.

In the different advantageous embodiments, the blast plate may be deformed when a blast occurs. The blast plate may both absorb and/or deflect a blast load. Further, the internal structure may absorb a load caused by a blast that may not be absorbed and/or deflected by the blast plate.

Figure 3:
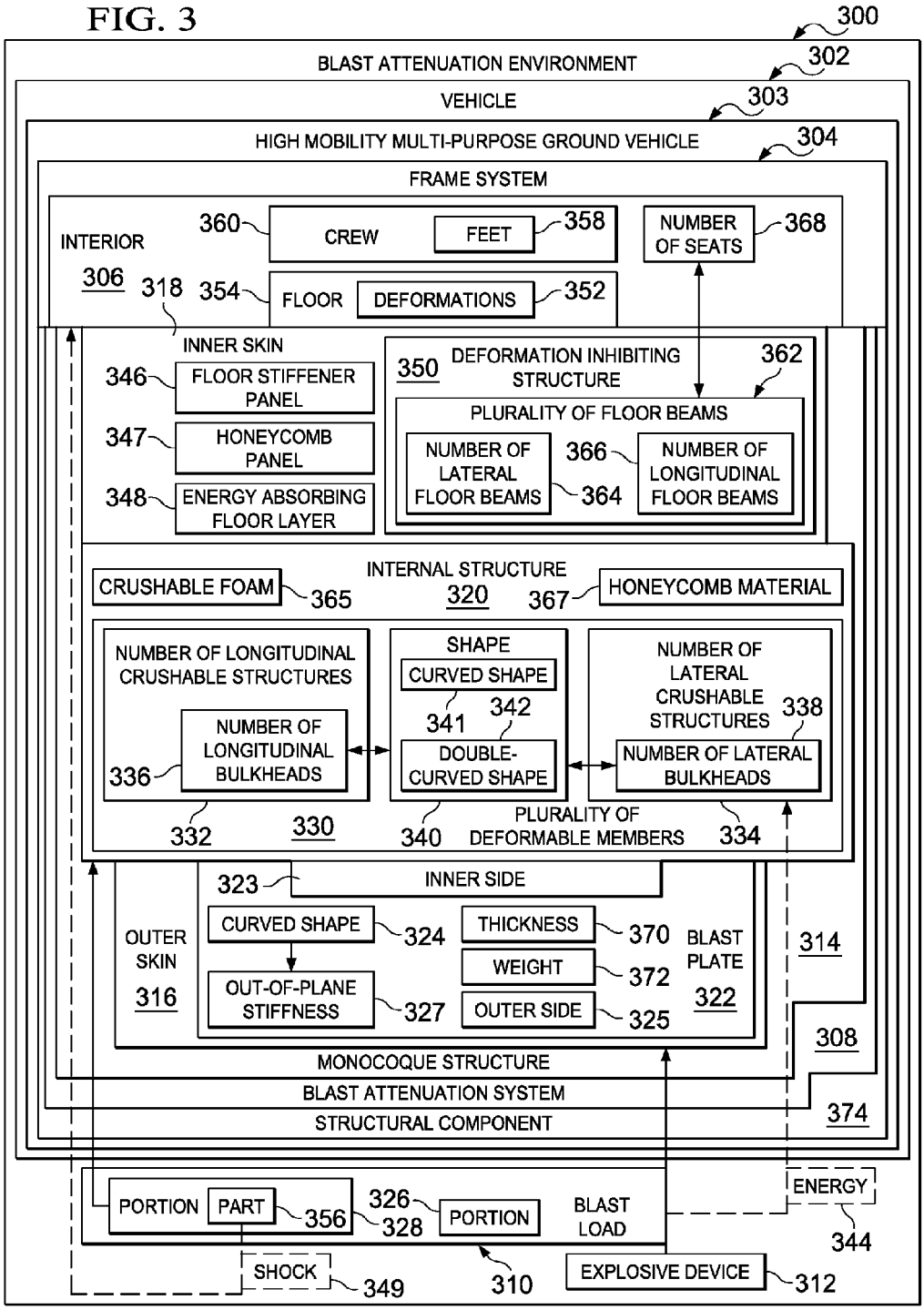
FIG. 3 is an illustration of a blast attenuation environment in accordance with an advantageous embodiment.

With reference now to FIG. 3, an illustration of a blast attenuation environment is depicted in accordance with an advantageous embodiment. In this illustrative example, blast attenuation environment 300 may include vehicle 302, which may have frame system 304 and interior 306. Vehicle 302 may be a vehicle, such as ground vehicle 200 in FIG. 2 or some other suitable type of vehicle. In these depicted examples, vehicle 302 may be high mobility multi-purpose ground vehicle 303.

In these illustrative examples, blast attenuation system 308 in blast attenuation environment 300 may provide at least one of a deflection of blast load 310 and an absorption of blast load 310 for vehicle 302. As used herein, the phrase "at least one of", when used with a list of items, means that different combinations of one or more of the listed items may be used and only one of each item in the list may be needed. For example, "at least one of item A, item B, and item C" may include, for example, without limitation, item A or item A and item B. This example also may include item A, item B, and item C or item B and item C.

Blast load 310 may be generated by, for example, without limitation, explosive device 312. Explosive device 312 may be, for example, without limitation, an improvised explosive device (IED), a mine, and/or some other explosive device.

In this illustrative example, blast attenuation system 308 may take the form of monocoque structure 314. Monocoque structure 314 may have outer skin 316, inner skin 318, and internal structure 320. Inner skin 318 may be exposed to interior 306 of vehicle 302.

In this depicted example, outer skin 316 may be a structure capable of absorbing and/or deflecting blast load 310. For example, without limitation, outer skin 316 may comprise blast plate 322 and/or some other suitable device that is capable of absorbing and/or deflecting blast load 310. Blast load 310 may be, for example, without limitation, any pressure load and/or fragment load applied to blast attenuation system 308 and/or vehicle 302.

Blast plate 322 may have inner side 323 and outer side 325. Inner side 323 may be attached to internal structure 320. Outer side 325 may encounter blast load 310. In this illustrative example, blast plate 322 may have curved shape 324.

In this illustrative example, blast plate 322 with curved shape 324 may deflect portion 326 of blast load 310 and absorb portion 328 of blast load 310. Curved shape 324 may curve upwards toward interior 306 of vehicle 302. Curved shape 324 may be referred to as a convex curve when curved shape 324 curves upwards toward interior 306. Curved shape 324 may be used for blast plate 322 in contrast to a V or angled shape used in currently available blast plates or a flat shape that may be found in other blast plates currently available. A flat shape for a blast plate may only provide in-plane stiffness. However, curved shape 324 may provide blast plate 322 with out-of-plane stiffness 327 that may reduce and/or prevent bending, buckling, plastic deformation, and/or some other change in blast plate 322. Curved shape 324 also may improve the blast attenuation capability of blast plate 322.

Internal structure 320 may attenuate and/or absorb portion 328 of blast load 310 to minimize and/or eliminate the effects of blast load 310 on interior 306 of vehicle 302. In these illustrative examples, internal structure 320 may include, for example, without limitation, plurality of deformable members 330. Plurality of deformable members 330 may act as shear carrying members within monocoque structure 314 and deform when exposed to portion 328 of blast load 310.

The deforming and/or crushing of plurality of deformable members 330 may absorb energy 344 from portion 328 of blast load 310 in a manner that may reduce and/or eliminate the effects of blast load 310 on the interior 306 of vehicle 302.

Plurality of deformable members 330 may be at least one of number of longitudinal crushable structures 332 and number of lateral crushable structures 334. Number of longitudinal crushable structures 332 and number of lateral crushable structures 334 may be substantially normal to each other. In other advantageous embodiments, number of longitudinal crushable structures 332 and number of lateral crushable structures 334 may be positioned at other angles such as, for example, without limitation, obtuse angles, acute angles, and/or some other angle.

In these illustrative examples, number of longitudinal crushable structures 332 may be number of longitudinal bulkheads 336, while number of lateral crushable structures 334 may be number of lateral bulkheads 338. Number of longitudinal bulkheads 336 and number of lateral bulkheads 338 may reduce deformation of blast plate 322. Further, number of longitudinal bulkheads 336 and number of lateral bulkheads 338 may deform to absorb portion 328 of blast load 310 transmitted through blast plate 322. Of course, other numbers and/or orientations of plurality of deformable members 330 may be present in addition to or in place of number of longitudinal crushable structures 332 and number of lateral crushable structures 334. Any orientation, type, and/or number of deformable structures may be selected to absorb portion 328 of blast load 310.

Number of longitudinal bulkheads 336 and number of lateral bulkheads 338 may have shape 340. Shape 340 may be capable of allowing number of longitudinal bulkheads 336 and/or number of lateral bulkheads 338 to deform and/or crush when exposed to portion 328 of blast load 310. In these illustrative examples, shape 340 may be selected from curved shape 341, double curved shape 342, and/or some other suitable shape. Double curved shape 342 also may be referred to as an S-shape. Of course, any shape or configuration may be selected that may allow for the crushing and/or deforming of number of longitudinal bulkheads 336 and/or number of lateral bulkheads 338. Further, different members in plurality of deformable members 330 may have different shapes.

In these illustrative examples, inner skin 318 may be a structure having a number of different components. For example, without limitation, inner skin 318 may comprise floor stiffener panel 346, honeycomb panel 347, energy absorbing floor layer 348, and/or deformation inhibiting structure 350.

Floor stiffener panel 346 and/or honeycomb panel 347 may reduce deformations 352 in floor 354 of interior 306 of vehicle 302. Energy absorbing floor layer 348 may isolate feet 358 of crew 360 and/or other items in vehicle 302 from portion 328 of blast load 310. Energy absorbing floor layer 348 may reduce and/or eliminate the transmission of shock 349 that may occur from part 356 of portion 328 of blast load 310 to feet 358 of crew 360 and/or equipment on floor 354 of vehicle 302. Shock 349 may be a part of portion 328 of blast load 310 reaching interior 306 of vehicle 302. In these examples, energy absorbing floor layer 348 may reduce shock 349 to feet 358 of crew 360 in interior 306 of vehicle 302.

Energy absorbing floor layer 348 may take various forms. For example, without limitation, energy absorbing floor layer 348 may be a crushable material, an elastic material, a honeycomb core, a foam core, and/or some other suitable material.

Deformation inhibiting structure 350 may be plurality of floor beams 362. Plurality of floor beams 362 may include at least one of number of lateral floor beams 364 and/or number of longitudinal floor beams 366. Number of seats 368 may be attached to plurality of floor beams 362 in these examples. Of course, deformation inhibiting structure 350 may be implemented using structures and/or components other than floor beams. For example, without limitation, deformation inhibiting structure 350 also may be comprised of at least one of honeycomb panels, foam panels, stringers, formed panels, stiffened panels, thick plates, a truss, and/or other suitable structures.

In this illustrative example, monocoque structure 314 may be attached to frame system 304 of vehicle 302. In these illustrative examples, inner skin 318 may be attached to frame system 304. Outer skin 316 may be attached to internal structure 320, and inner skin 318 also may be attached to internal structure 320. In other words, internal structure 320 may be located between inner skin 318 and outer skin 316.

In the illustrative examples, blast plate 322 may be comprised of any material suitable for deflecting and/or absorbing blast load 310. For example, without limitation, blast plate 322 may be comprised of a metallic material, aluminum, titanium, steel, a steel alloy, a ceramic material, a composite material, and/or some other suitable material. Blast plate 322 may have layers of materials, a single layer of a selected material, and/or some other suitable configuration.

With blast attenuation system 308, blast plate 322 may be constructed with thickness 370 and weight 372. Thickness 370 and weight 372 may be less than currently used thicknesses and weights in conventional blast plates. Thickness 370 and weight 372 may be reduced using internal structure 320 to increase portion 328 of blast load 310 absorbed by blast attenuation system 308. By having blast plate 322 absorb less of portion 328 of blast load 310, blast plate 322 may be constructed to have thickness 370 and/or weight 372 that may be reduced as compared to conventionally-used blast plates. In contrast to currently used blast plates, blast attenuation system 308 may not rely on the resisting of deformation. Instead, portion 328 of blast load 310 may be absorbed through deformation of internal structure 320 and/or blast plate 322.

The different components illustrated for blast attenuation system 308 may be connected to each other using a number of different mechanisms. For example, without limitation, the different components may be connected by welding, bolting, bonding, and/or some other suitable method for connecting components. Further, the different components in blast attenuation system 308 may be comprised of various types of material that may be used for structural materials.

In some advantageous embodiments, blast attenuation system 308 may form structural component 374, which may be attached to and/or form part of frame system 304 of vehicle 302. This advantageous embodiment may reduce the weight of vehicle 302 by replacing a portion of or all of structural component 374 and/or frame system 304.

The illustration of blast attenuation environment 300 in FIG. 3 is not meant to imply physical or architectural limitations to the manner in which different advantageous embodiments may be implemented. Other components in addition to and/or in place of the ones illustrated may be used. Some components may be unnecessary in some advantageous embodiments. Also, the blocks are presented to illustrate some functional components. One or more of these blocks may be combined and/or divided into different blocks when implemented in different advantageous embodiments.

For example, although vehicle 302 is illustrated as high mobility multipurpose ground vehicle 303, vehicle 302 may take other forms. For example, without limitation, vehicle 302 may be a car, a truck, a spacecraft, a ship, a tank, an armored personnel carrier, and/or some other suitable type of vehicle.

In other illustrative examples, in some advantageous embodiments, internal structure 320 also may include crushable foam 365 and/or honeycomb material 367 in addition to or in lieu of plurality of deformable members 330. Crushable foam 365 and/or honeycomb material 367 may be structural shear members within internal structure 320. In still other advantageous embodiments, outer skin 316 may include an additional skin in addition to blast plate 322.

In still other advantageous embodiments, inner skin 318 may comprise other components in addition to floor stiffener panel 346, honeycomb panel 347, energy absorbing floor layer 348, and deformation inhibiting structure 350. In some advantageous embodiments, floor stiffener panel 346 and/or energy absorbing floor layer 348 may not be considered part of inner skin 318.

Figure 4:
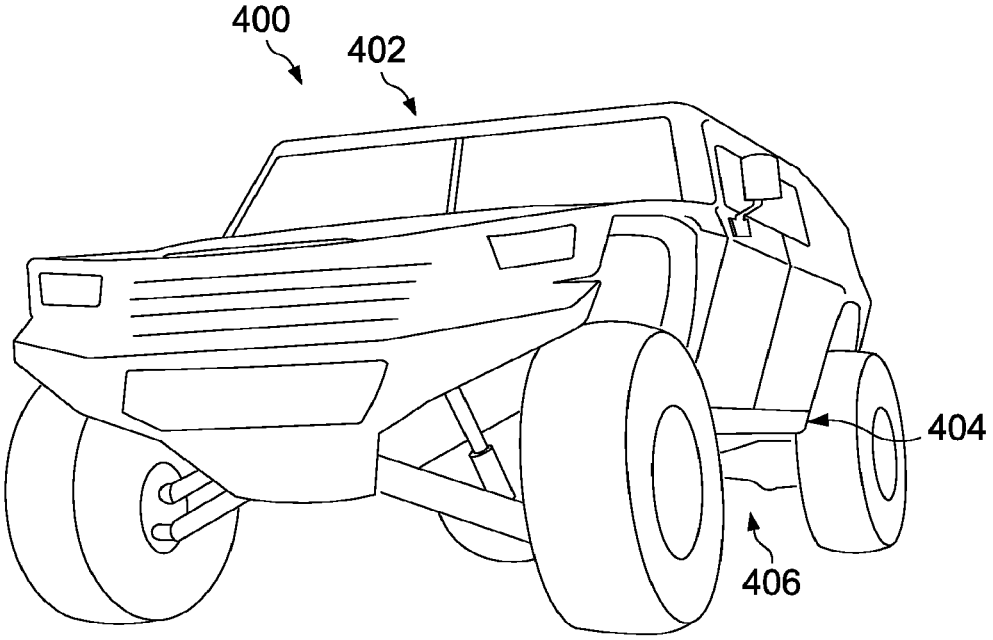
FIG. 4 is an illustration of a vehicle in accordance with an advantageous embodiment.

With reference now to FIG. 4, an illustration of a vehicle is depicted in accordance with an advantageous embodiment. In this illustrative example, ground vehicle 400 is an example of one implementation for vehicle 302 in FIG. 3. Ground vehicle 400 may be, for example, without limitation, high mobility multi-purpose ground vehicle 402 in these illustrative examples. In this illustrative example, blast attenuation system 404 may be located on underside 406 of ground vehicle 400.

Turning now to FIGS. 5-9, illustrations of a blast attenuation system are depicted in accordance with an advantageous embodiment. In these examples, the illustrations of blast attenuation system 404 are examples of one implementation for use with ground vehicle 400.

Figure 5:
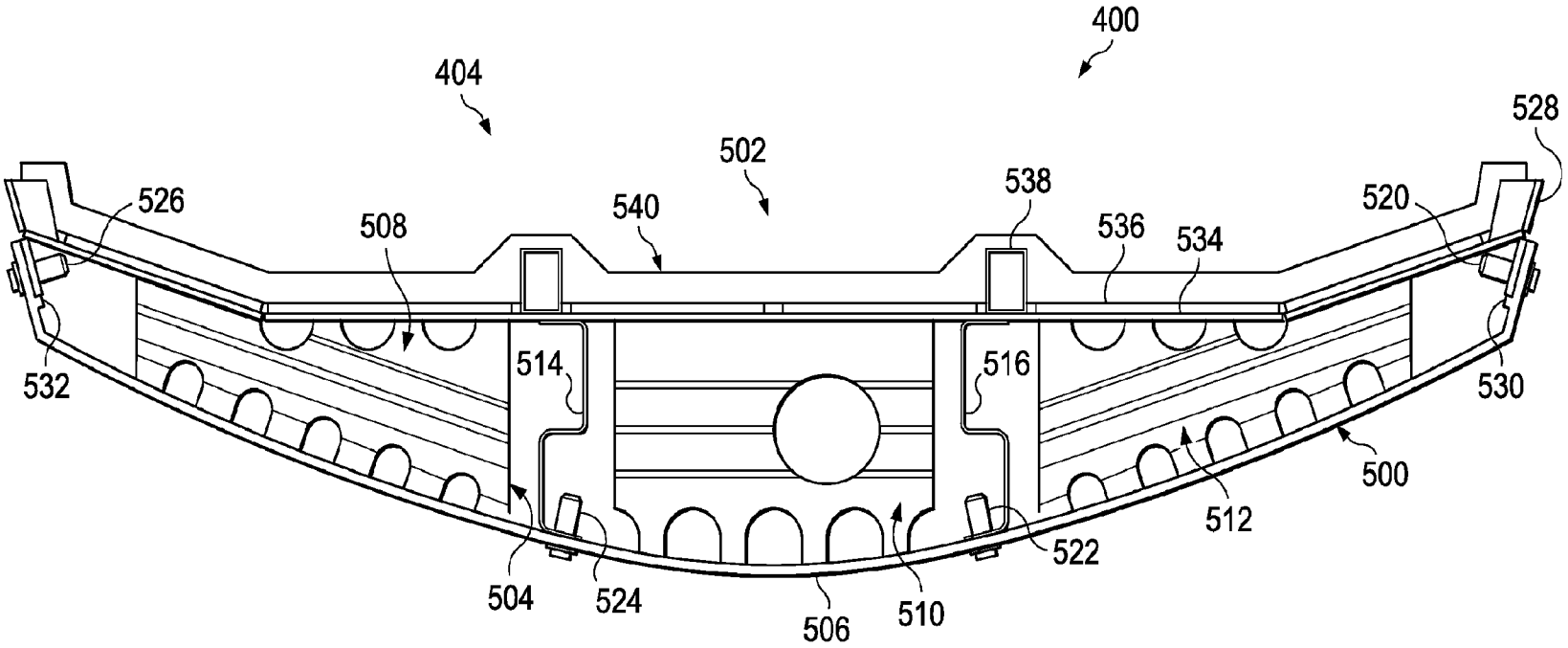
FIG. 5 is an illustration of a cross-sectional view of a blast attenuation system in accordance with an advantageous embodiment.

With reference to FIG. 5, an illustration of a cross-sectional view of a blast attenuation system is depicted in accordance with an advantageous embodiment. In this example, blast attenuation system 404 may have outer skin 500, inner skin 502, and internal structure 504.

In this illustrative example, outer skin 500 may take the form of blast plate 506. Internal structure 504 may be comprised of elements, such as lateral bulkheads 508, 510, and 512 and longitudinal bulkheads 514 and 516.

Internal structure 504 and blast plate 506 may be attached to each other using fasteners, such as fasteners 520, 522, 524, and 526. In this depicted example, fastener 520 and fastener 526 may connect blast plate 506 to frame 528. Additionally, blast plate buttresses 530 and 532 may be present. Blast plate buttresses 530 and 532 may prevent movement of fasteners 520 and/or 526 in a manner that avoids shearing of these fasteners.

Inner skin 502 may comprise floor 534, floor stiffener panel 536, deformation inhibiting structure 538, and energy absorbing floor layer 540. In these illustrative examples, floor stiffener panel 536 also may absorb energy from a blast load. Further, floor stiffener panel 536 may be arranged in floor 534 to protect occupants and/or equipment that may be located within vehicle 400. In these illustrative examples, energy absorbing layer 540 may be used with floor stiffener panel 536 to absorb energy from a blast load and/or to isolate occupants and/or equipment touching floor 534. These components may not be needed in some advantageous embodiments.

This cross-sectional view may show some of the components present within blast attenuation system 404. For example, without limitation, blast attenuation system 404 may include additional fasteners, stringers, bulkheads, and/or other structures not shown in this particular view.

Figure 6:
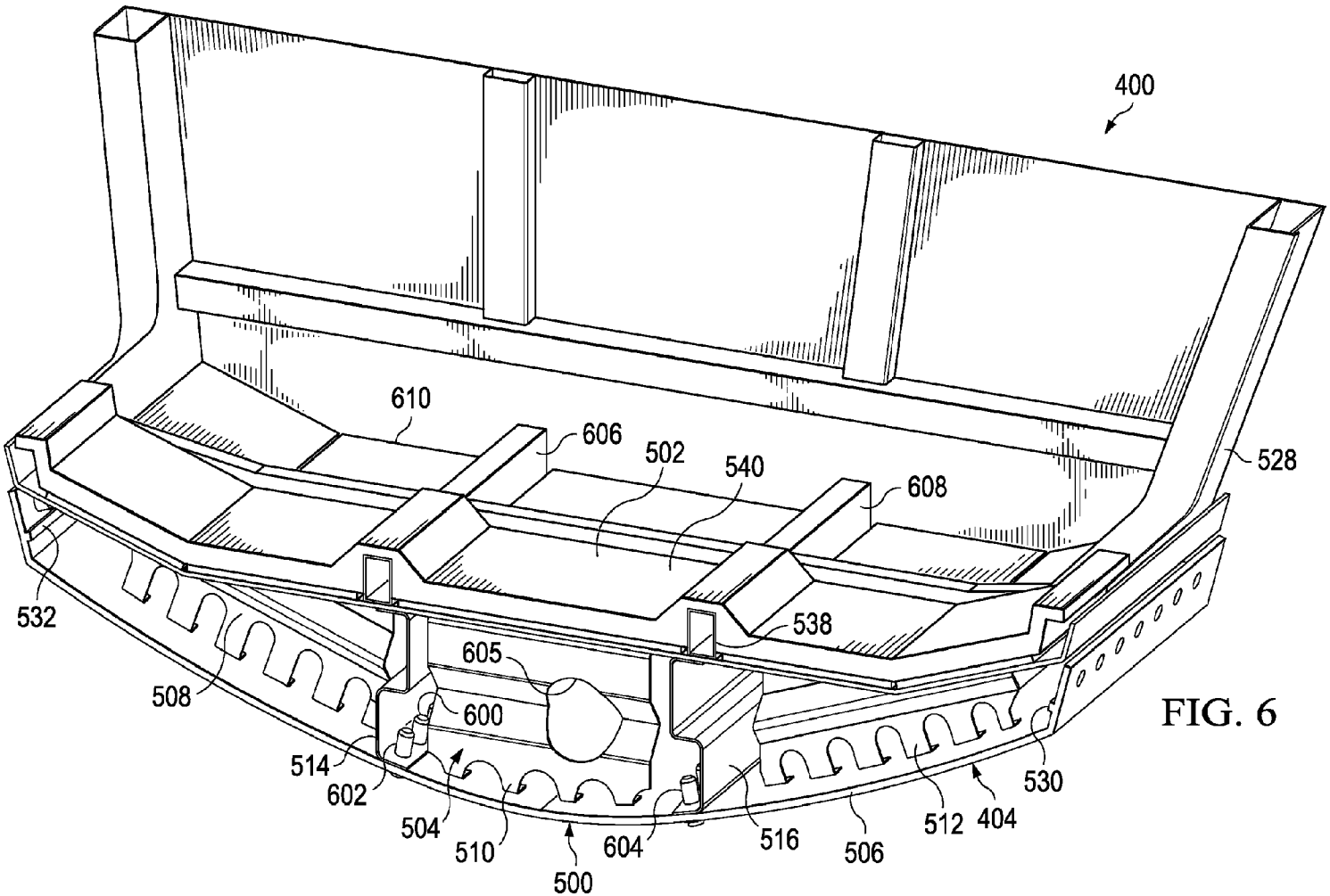
FIG. 6 is an illustration of a perspective cross-sectional view of a blast attenuation system in accordance with an advantageous embodiment.

Turning now to FIG. 6, an illustration of a perspective cross-sectional view of a blast attenuation system is depicted in accordance with an advantageous embodiment. In this view, additional fasteners, such as fasteners 600, 602, and 604 also may be seen in this particular view.

In this illustrative example, lateral bulkheads 508, 510, and 512 may have a double curved shape, which may be referred to as an S shape. In a similar fashion, longitudinal bulkheads 514 and 516 also may have an S shape. In other illustrative examples, lateral bulkheads 508, 510, and 512 and/or longitudinal bulkheads 514 and 516 may have a curved shape and/or some other suitable shape.

Further, these different components within internal structure 504 also may include configurations to allow components within ground vehicle 400 to pass through internal structure 504. For example, without limitation, lateral bulkhead 510 may have hole 605 to allow a component such as, for example, without limitation, a driveshaft, a brake line, an electrical harness, and/or some other suitable component to pass through lateral bulkhead 510.

In this example, lateral floor beams 606 and 608 may be seen to cross longitudinal floor beam 610 in deformation inhibiting structure 538.

Figure 7:
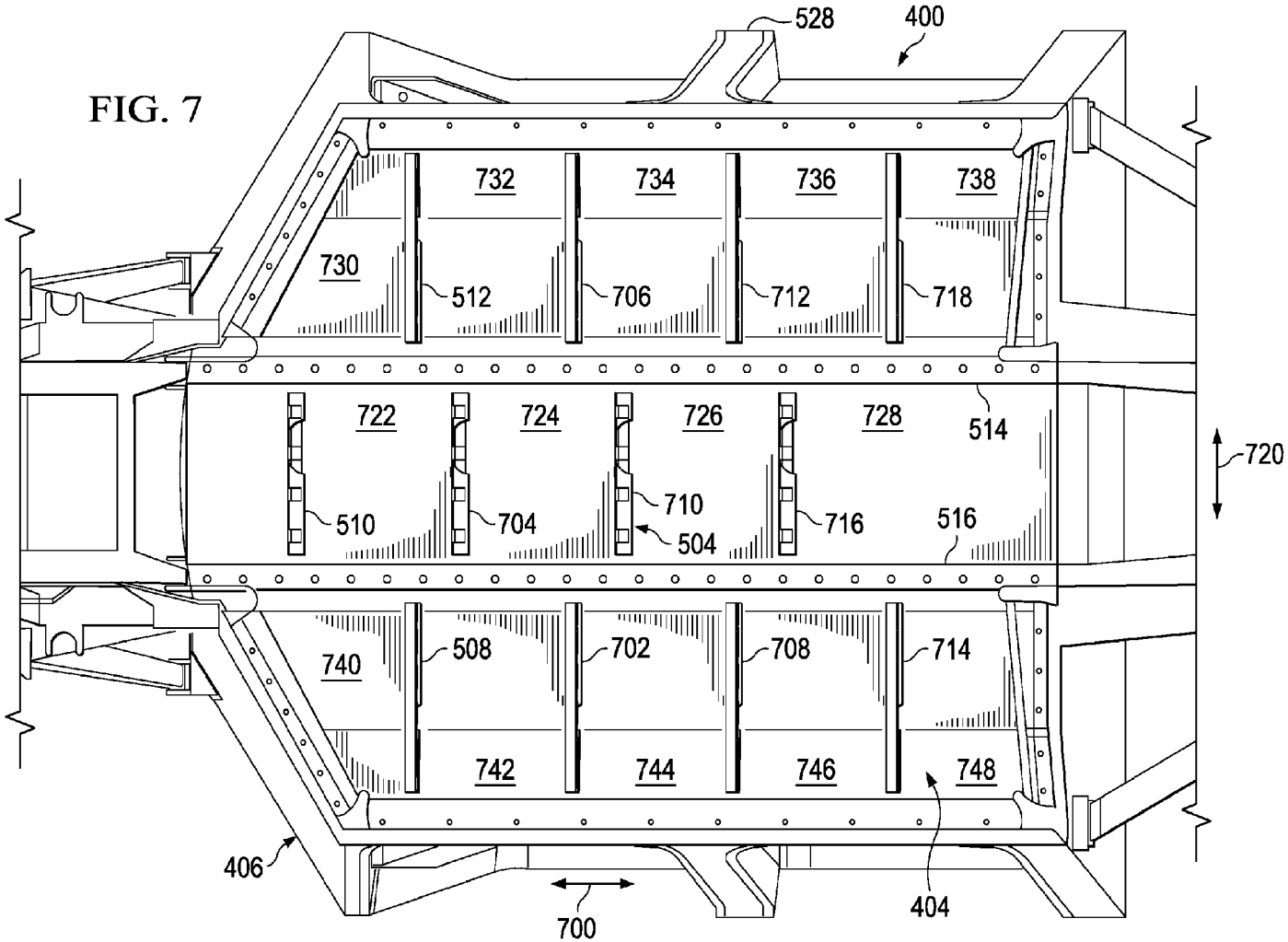
FIG. 7 is an illustration of a bottom exposed view of a blast attenuation system in accordance with an advantageous embodiment.

Turning now to FIG. 7, an illustration of a bottom exposed view of a blast attenuation system is depicted in accordance with an advantageous embodiment. In this example, blast attenuation system 404 is seen from underside 406 of ground vehicle 400. Blast attenuation system 404 may be seen without outer skin 500 in the form of blast plate 506.

From this view, longitudinal bulkheads 514 and 516 are depicted extending along ground vehicle 400 in the direction of arrow 700. Lateral bulkheads 508, 510, 512, 702, 704, 706, 708, 710, 712, 714, 716, and 718 are depicted as extending along ground vehicle 400 in the direction of arrow 720.

Although twelve lateral bulkheads and two longitudinal bulkheads are shown in this illustrative example, other implementations of blast attenuation system 404 may employ other numbers of bulkheads. Further, in some advantageous embodiments, foam, honeycomb material, and/or other crushable shear members (not shown) may be included within internal structure 504. The foam, honeycomb material, and/or other crushable shear members may be located in spaces, such as spaces 722, 724, 726, 728, 730, 732, 734, 736, 738, 740, 742, 744, 746, and 748.

In yet other advantageous embodiments, internal structure 504 may include skin stiffeners (not shown). These skin stiffeners may be attached to blast plate 506 and/or inner skin 502. Further, these skin stiffeners may absorb energy and/or limit deformation of blast plate 506 and/or inner skin 502.

Figure 8:
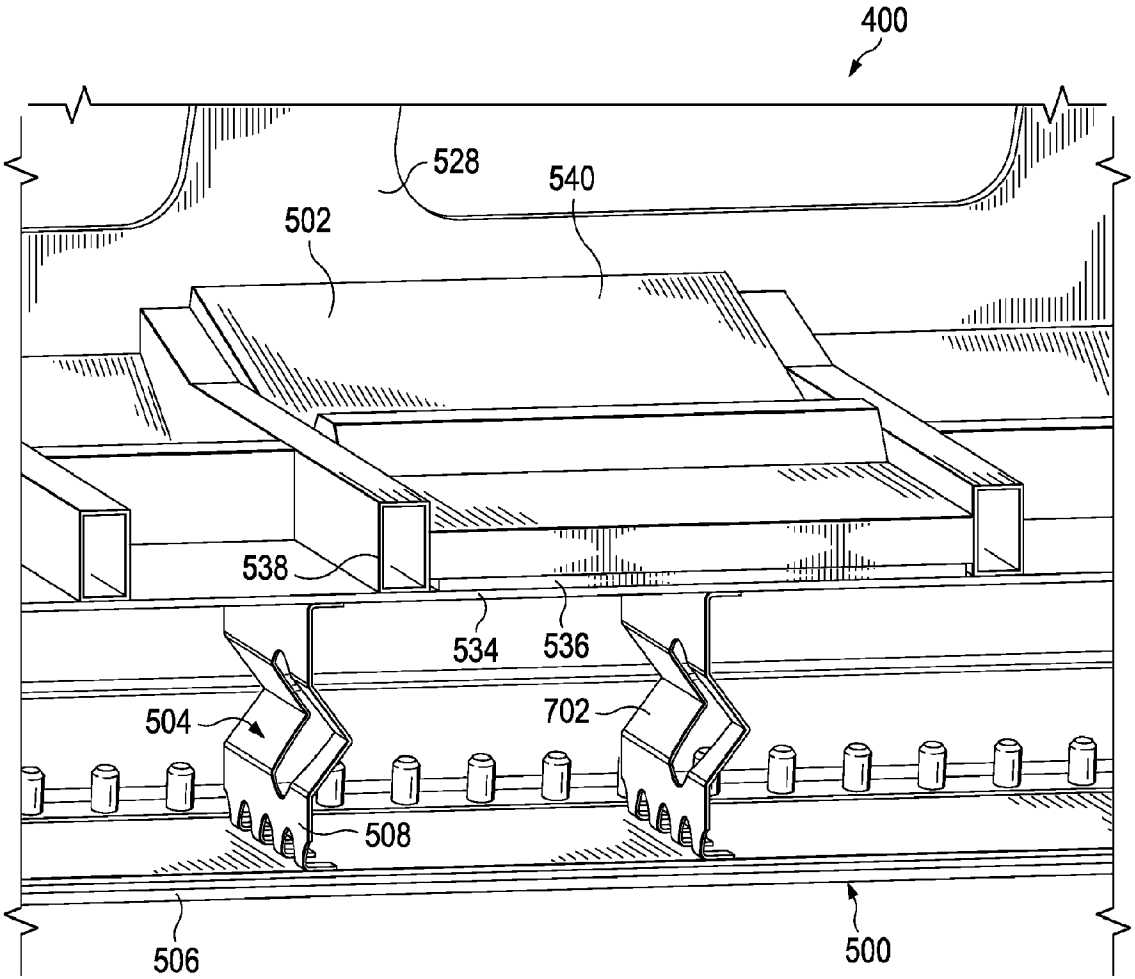
FIG. 8 is an illustration of a partial side cross-sectional perspective view of a blast attenuation system in accordance with an advantageous embodiment.

Turning next to FIG. 8, an illustration of a partial side cross-sectional perspective view of a blast attenuation system is depicted in accordance with an advantageous embodiment. In this illustrative example, a partial longitudinal exposed view of blast attenuation system 404 is depicted in accordance with an advantageous embodiment.

Figure 9:
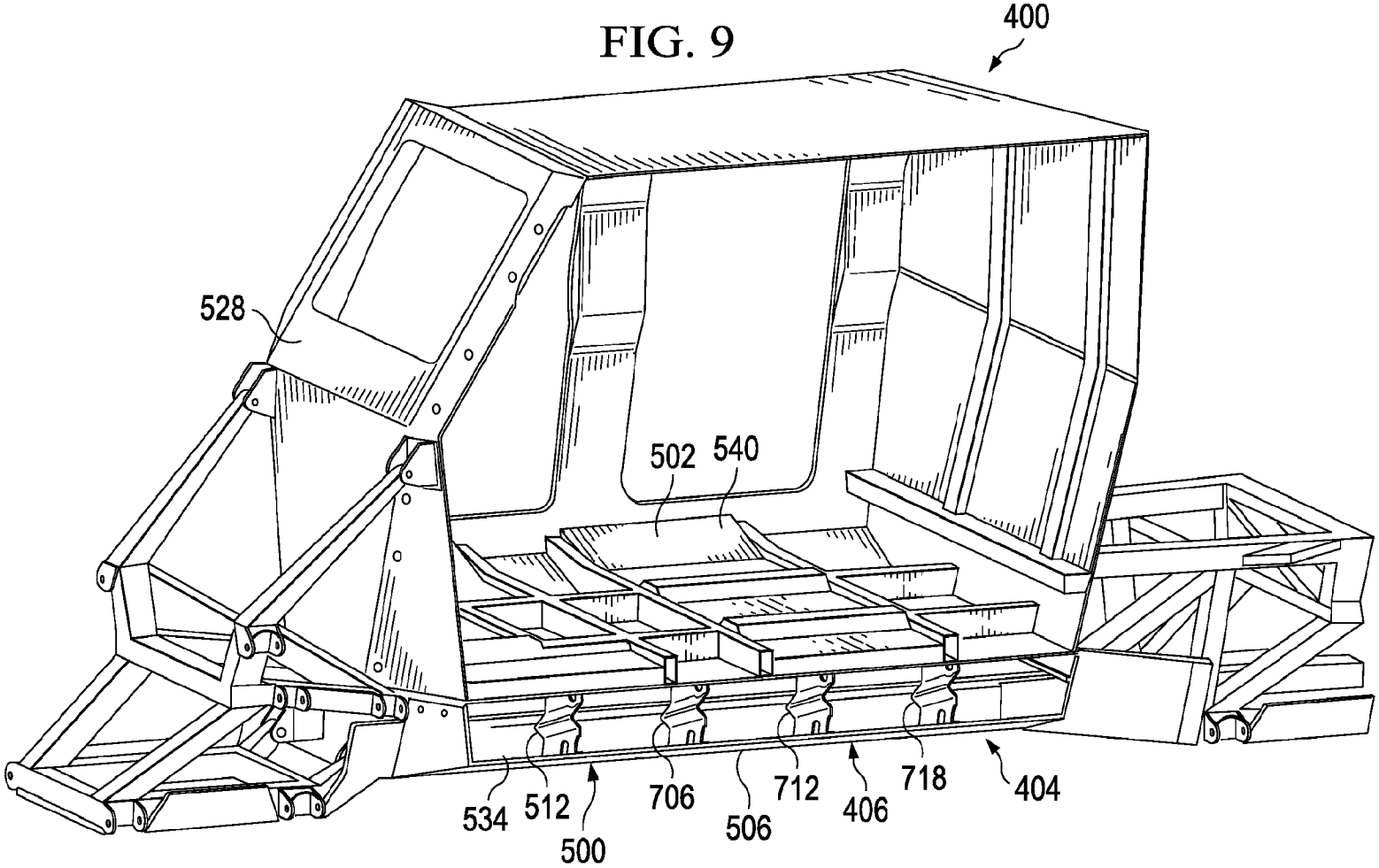
FIG. 9 is an illustration of a cross-sectional perspective partially exposed view of a blast attenuation system in accordance with an advantageous embodiment.

With reference now to FIG. 9, an illustration of a cross-sectional perspective partially exposed view of a blast attenuation system is depicted in accordance with an advantageous embodiment. In this illustrative example, blast attenuation system 404 may be attached to frame 528 of ground vehicle 400. As can be seen in this illustrative example, blast attenuation system 404 may be secured to frame 528 and may form floor 534 for ground vehicle 400. In other advantageous embodiments, blast attenuation system 404 may include a portion of frame 528.

Figure 10:
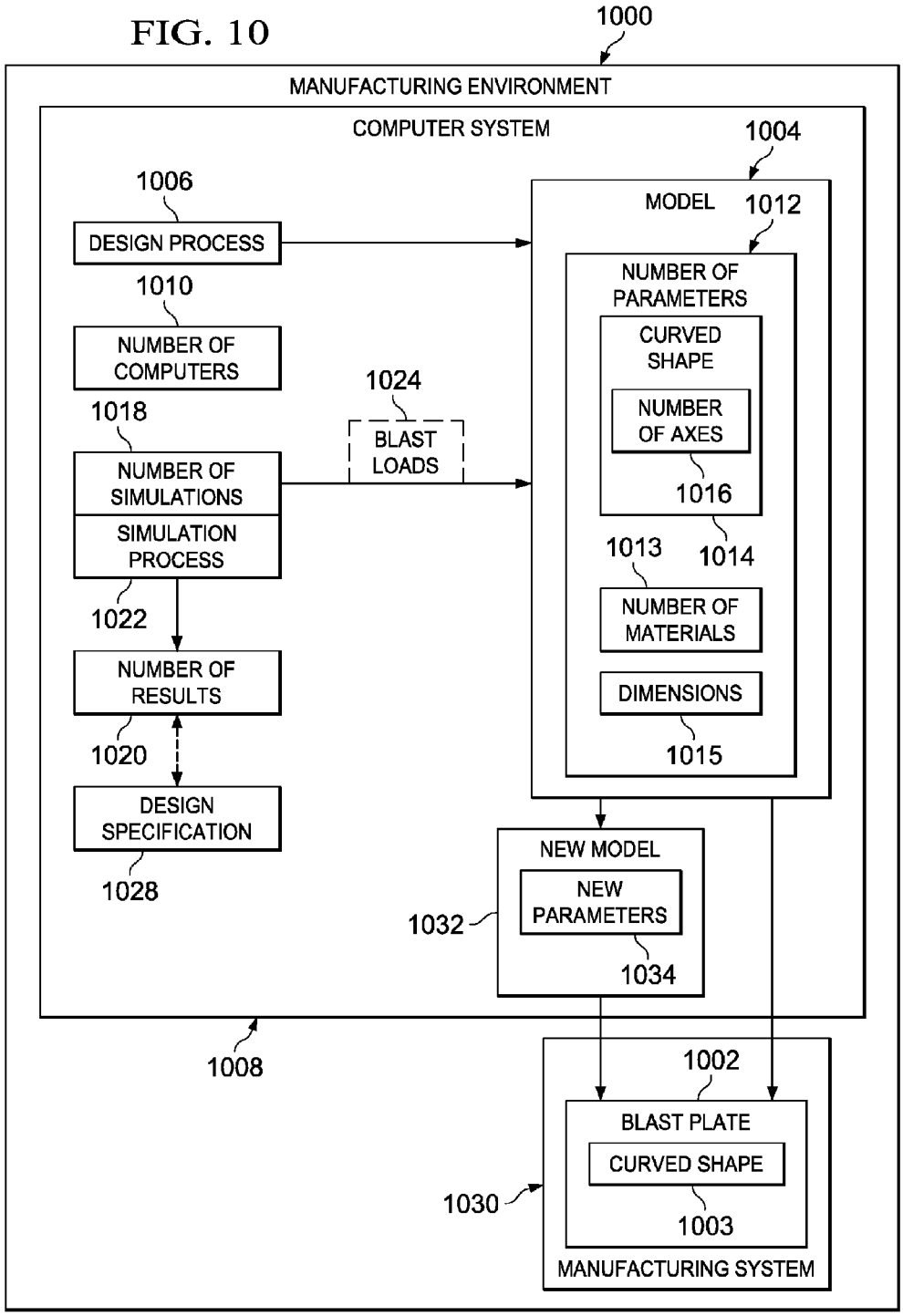
FIG. 10 is an illustration of a block diagram of a manufacturing environment for a blast plate in accordance with an advantageous embodiment.

With reference now to FIG. 10, an illustration of a block diagram of a manufacturing environment for a blast plate is depicted in accordance with an advantageous embodiment. In this illustrative example, manufacturing environment 1000 may be used to manufacture blast plate 1002. Blast plate 1002 may have curved shape 1003 in these illustrative examples and is an illustrative example of blast plate 322 in FIG. 3. Blast plate 1002 may be implemented in a vehicle such as, for example, without limitation, ground vehicle 400 in FIG. 4.

In some advantageous embodiments, model 1004 may be a model for blast plate 1002. Model 1004 may be created using design process 1006. Model 1004 may be, for example, a computer aided design model, and design process 1006 may be a computer aided design tool executing on computer system 1008. Computer system 1008 may be number of computers 1010, and number of computers 1010 may be in communication with each other. In these illustrative examples, model 1004 may include number of parameters 1012 such as, for example, without limitation, curved shape 1014, number of materials 1013, dimensions 1015, and/or other suitable parameters for blast plate 1002. Curved shape 1014 may be used to create curved shape 1003 for blast plate 1002.

For example, without limitation, curved shaped 1014, may be, for example, without limitation a partial cylinder, a partial dome, and/or some other suitable shape. Curved shape 1014 may also be non-uniform. For example, without limitation, curved shape 1014 may be a partial cylinder that changes in dimensions along number of axes 1016. Also, curved shape 1014 may change from a partial cylinder to a partial dome in shape along axis 1016 and/or along some other axis associated with blast plate 1002. Further, curved shape 1014 may be multi-faceted and approach the shape of a partial cylinder in a stepwise manner.

Once model 1004 has been created, number of simulations 1018 may be run on model 1004 to generate number of results 1020. Number of simulations 1018 may be run using simulations process 1022 executing on computer system 1008. Simulations process 1022 may be a process and/or computer program capable of simulating blast loads 1024 on model 1004 for blast plate 1002. For example, without limitation, simulations process 1022 may be a finite element analysis program.

Number of results 1020 may be obtained from running number of simulations 1018. Number of results 1020 may be compared to design specification 1028. If number of results 1020 meets design specification 1028, blast plate 1002 may be manufactured in manufacturing system 1030 using model 1004. Manufacturing system 1030 may be for example without limitation any equipment capable of manufacturing blast plate 1002 following model 1004. For example, manufacturing system 1030 may include a blast furnace, a mold, an oven, a press, and/or any other suitable piece of equipment.

If number of results 1020 does not meet design specification 1028, model 1004 may be changed to form new model 1032. The change may be made to number of parameters 1012 such as, for example, without limitation, curved shape 1014, number of materials 1013, dimensions 1015 and/or any other suitable parameters. Some of number of parameters 1012 may be fixed depending on design specification 1028. The changes may form new parameters 1034 in new model 1032. Number of simulations 1018 may be run on new model 1032 until number of results 1020 meets design specifications 1028. Then, blast plate 1002 may be manufactured using manufacturing system 1030 and new model 1032.

The illustration of manufacturing environment 1000 in FIG. 10 is not meant to imply physical or architectural limitations to the manner in which different advantageous embodiments may be implemented. Other components in addition to and/or in place of the ones illustrated may be used. Some components may be unnecessary in some advantageous embodiments. Also, the blocks are presented to illustrate some functional components. One or more of these blocks may be combined and/or divided into different blocks when implemented in different advantageous embodiments.

Figure 11:
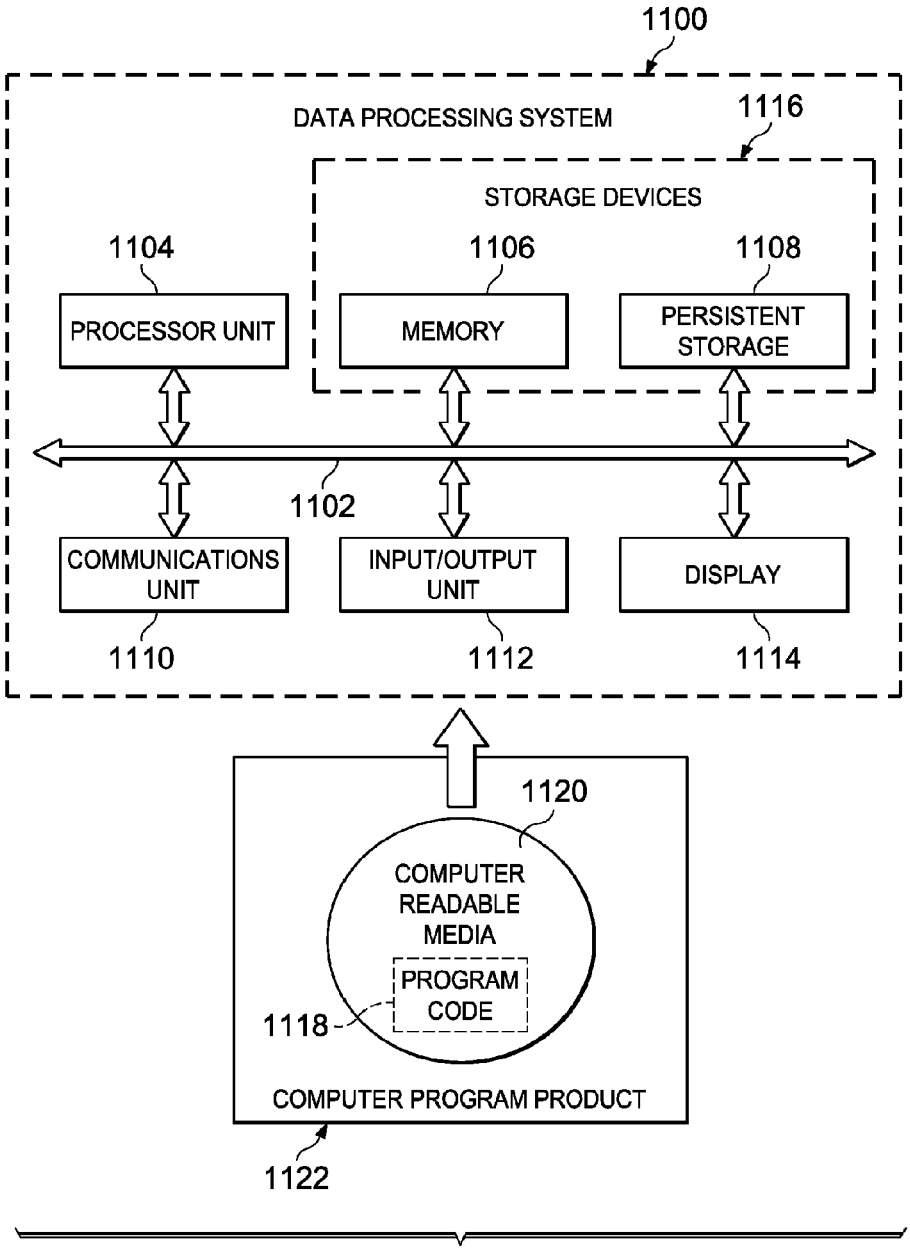
FIG. 11 is a diagram of a data processing system in accordance with an illustrative embodiment.

Turning now to FIG. 11, a diagram of a data processing system is depicted in accordance with an illustrative embodiment. Data processing 1100 may be used to implement number of computers 1010 in computer system 1008 in FIG. 10. In this illustrative example, data processing system 1100 includes communications fabric 1102, which provides communications between processor unit 1104, memory 1106, persistent storage 1108, communications unit 1110, input/output (I/O) unit 1112, and display 1114.

Processor unit 1104 serves to execute instructions for software that may be loaded into memory 1106. Processor unit 1104 may be a set of one or more processors or may be a multi-processor core, depending on the particular implementation. Further, processor unit 1104 may be implemented using one or more heterogeneous processor systems in which a main processor is present with secondary processors on a single chip. As another illustrative example, processor unit 1104 may be a symmetric multi-processor system containing multiple processors of the same type.

Memory 1106 and persistent storage 1108 are examples of storage devices 1116. A storage device is any piece of hardware that is capable of storing information, such as, for example without limitation, data, program code in functional form, and/or other suitable information either on a temporary basis and/or a permanent basis. Memory 1106, in these examples, may be, for example, a random access memory or any other suitable volatile or non-volatile storage device. Persistent storage 1108 may take various forms depending on the particular implementation. For example, persistent storage 1108 may contain one or more components or devices. For example, persistent storage 1108 may be a hard drive, a flash memory, a rewritable optical disk, a rewritable magnetic tape, or some combination of the above. The media used by persistent storage 1108 also may be removable. For example, a removable hard drive may be used for persistent storage 1108.

Communications unit 1110, in these examples, provides for communications with other data processing systems or devices. In these examples, communications unit 1110 is a network interface card. Communications unit 1110 may provide communications through the use of either or both physical and wireless communications links.

Input/output unit 1112 allows for input and output of data with other devices that may be connected to data processing system 1100. For example, input/output unit 1112 may provide a connection for user input through a keyboard, a mouse, and/or some other suitable input device. Further, input/output unit 1112 may send output to a printer. Display 1114 provides a mechanism to display information to a user.

Instructions for the operating system, applications and/or programs may be located in storage devices 1116, which are in communication with processor unit 1104 through communications fabric 1102. In these illustrative examples the instruction are in a functional form on persistent storage 1108. These instructions may be loaded into memory 1106 for execution by processor unit 1104. The processes of the different embodiments may be performed by processor unit 1104 using computer implemented instructions, which may be located in a memory, such as memory 1106.

These instructions are referred to as program code, computer usable program code, or computer readable program code that may be read and executed by a processor in processor unit 1104. The program code in the different embodiments may be embodied on different physical or tangible computer readable media, such as memory 1106 or persistent storage 1108.

Program code 1118 is located in a functional form on computer readable media 1120 that is selectively removable and may be loaded onto or transferred to data processing system 1100 for execution by processor unit 1104. Program code 1118 and computer readable media 1120 form computer program product 1122 in these examples. In one example, computer readable media 1120 may be in a tangible form, such as, for example, an optical or magnetic disc that is inserted or placed into a drive or other device that is part of persistent storage 1108 for transfer onto a storage device, such as a hard drive that is part of persistent storage 1108. In a tangible form, computer readable media 1120 also may take the form of a persistent storage, such as a hard drive, a thumb drive, or a flash memory that is connected to data processing system 1100. The tangible form of computer readable media 1120 is also referred to as computer recordable storage media. In some instances, computer readable media 1120 may not be removable.

Alternatively, program code 1118 may be transferred to data processing system 1100 from computer readable media 1120 through a communications link to communications unit 1110 and/or through a connection to input/output unit 1112. The communications link and/or the connection may be physical or wireless in the illustrative examples. The computer readable media also may take the form of non-tangible media, such as communications links or wireless transmissions containing the program code.

In some illustrative embodiments, program code 1118 may be downloaded over a network to persistent storage 1108 from another device or data processing system for use within data processing system 1100. For instance, program code stored in a computer readable storage medium in a server data processing system may be downloaded over a network from the server to data processing system 1100. The data processing system providing program code 1118 may be a server computer, a client computer, or some other device capable of storing and transmitting program code 1118.

The different components illustrated for data processing system 1100 are not meant to provide architectural limitations to the manner in which different embodiments may be implemented. The different illustrative embodiments may be implemented in a data processing system including components in addition to or in place of those illustrated for data processing system 1100. Other components shown in FIG. 11 can be varied from the illustrative examples shown. The different embodiments may be implemented using any hardware device or system capable of executing program code. As one example, the data processing system may include organic components integrated with inorganic components and/or may be comprised entirely of organic components excluding a human being. For example, a storage device may be comprised of an organic semiconductor.

As another example, a storage device in data processing system 1100 is any hardware apparatus that may store data. Memory 1106, persistent storage 1108 and computer readable media 1120 are examples of storage devices in a tangible form.

Figure 12:
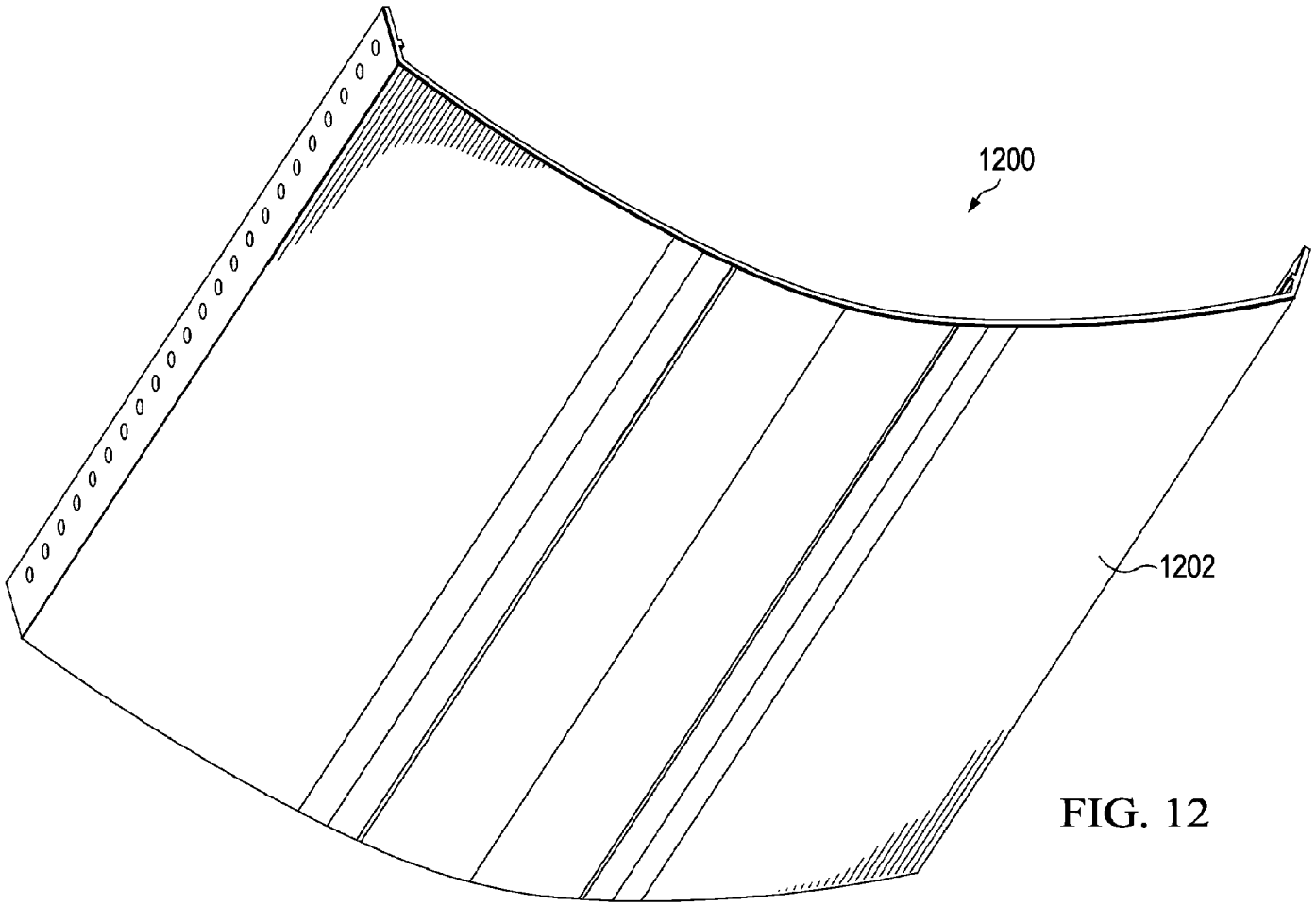
FIG. 12 is an illustration of a curved shape for a blast plate in accordance with an advantageous embodiment.

With reference now to FIG. 12, an illustration of a curved shape for a blast plate is depicted in accordance with an advantageous embodiment. In this illustrative example, curved shape 1200 is shown in perspective view. Curved shape 1200 may be an example of one implementation for curved shape 1003 for blast plate 1002 in FIG. 10. In the depicted example, curved shape 1200 may be partial cylinder 1202.

Figure 13:
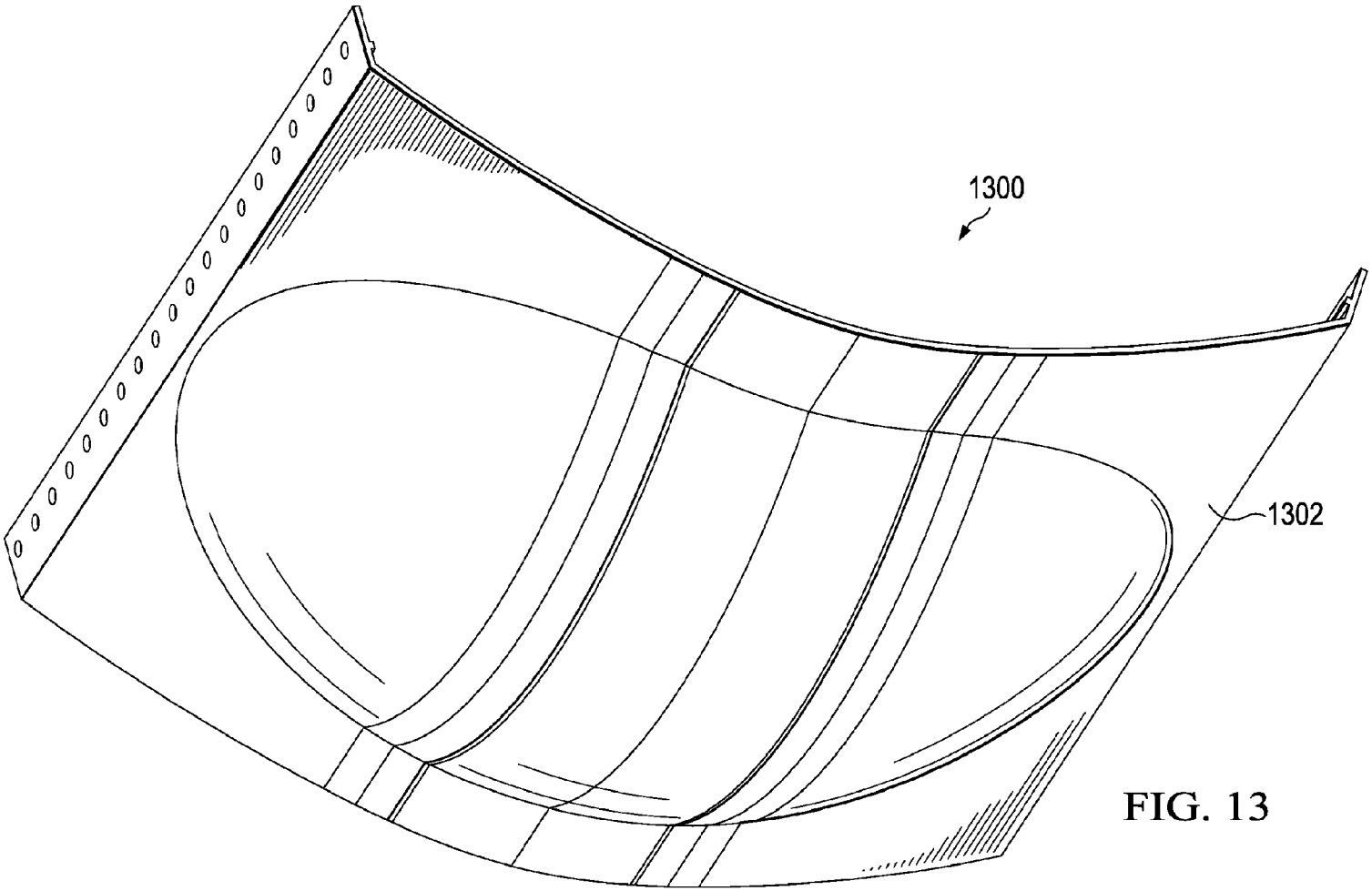
FIG. 13 is an illustration of a curved shape for a blast plate in accordance with an advantageous embodiment.

With reference now to FIG. 13, an illustration of a curved shape for a blast plate is depicted in accordance with an advantageous embodiment. In this illustrative example, curved shape 1300 is shown in perspective view. Curved shape 1300 may be one example of one implementation for curved shape 1003 for blast plate 1002 in FIG. 10. Curved shape 1300 may be partial dome 1302 in this example.

Figure 14:
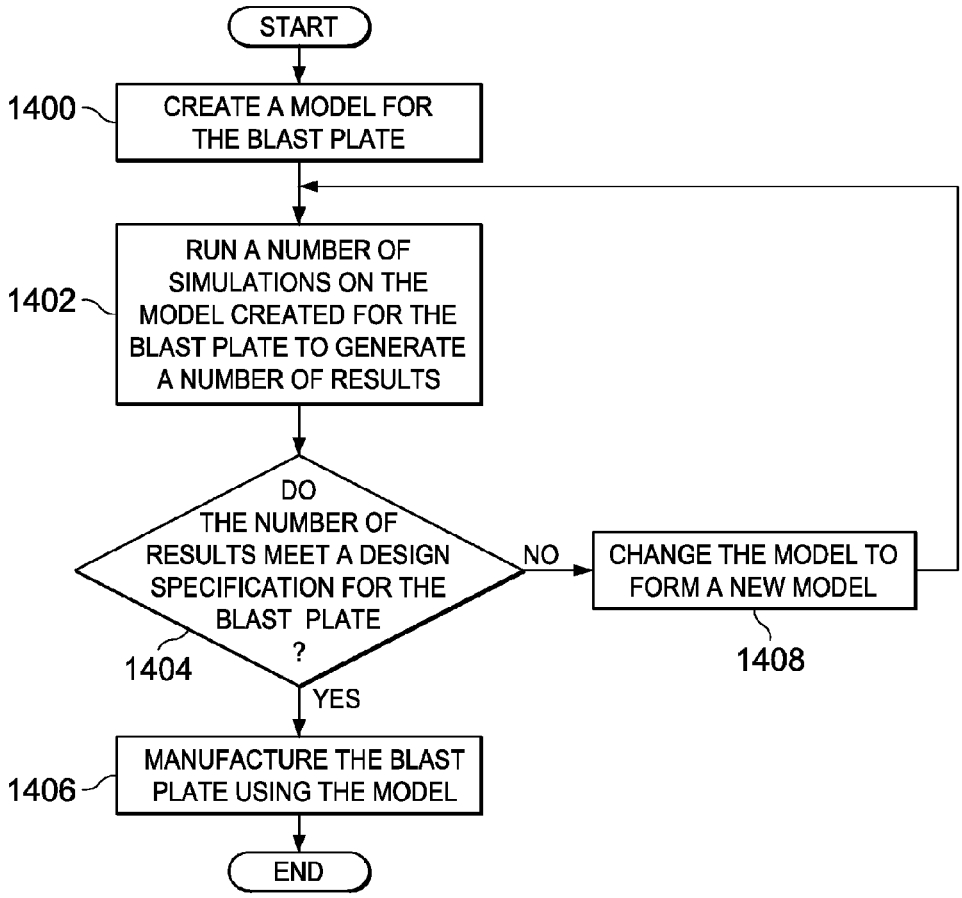
FIG. 14 is an illustration of a flowchart of a process for manufacturing a blast plate in accordance with an advantageous embodiment.

Turning next to FIG. 14, an illustration of a flowchart of a process for manufacturing a blast plate is depicted in accordance with an advantageous embodiment. In these illustrative examples, the process may be implemented in ground vehicle manufacturing and service method 100 in FIG. 1. As a specific example, this process may be implemented during specification and design 102 in FIG. 1. The process illustrated in FIG. 14, may be implemented in manufacturing environment 1000 in FIG. 10 to manufacture blast plate 1002. One or more of the operations may be implemented in design process 1006 and/or simulation process 1022. A number of operations may be implemented in manufacturing system 1030.

The process may begin by creating model 1004 for blast plate 1002 (operation 1400). Model 1004 may include curved shape 1014 for blast plate 1002. Number of simulations 1018 may be run using model 1004 created for blast plate 1002 to generate number of results 1020 (operations 1402). A determination may be made as to whether number of results 1020 meets design specification 1028 for blast plate 1002 (operations 1404). Responsive to model 1004 meeting design specification 1028, the process may manufacture blast plate 1002 using model 1004 (operation 1406), with the process terminating thereafter. If number of results 1020 does not meet design specification 1028, model 1004 may be changed to form new model 1032 (operations 1408), with the process then returning to operation 1402. Changing model 1004 may include changing curved shape 1014 for model 1004. Changing curved shape 1014 for model 1004 may include, for example, without limitation, changing the contour, curve, thickness, and/or other parameters for curved shape 1014. Once number of results 1020 meets design specification 1028 with new model 1032, the process may manufacture blast plate 1002 using new model 1032 in operation 1406, with the process terminating thereafter.

Figure 15:
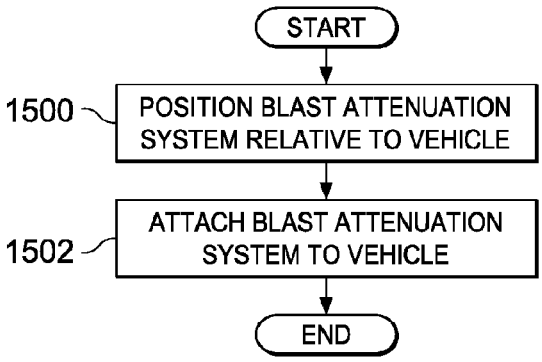
FIG. 15 is an illustration of a flowchart for installing a blast attenuation system in accordance with an advantageous embodiment.

Turning next to FIG. 15, an illustration of a flowchart for installing a blast attenuation system is depicted in accordance with an advantageous embodiment. The process illustrated in FIG. 15 may be used to install blast attenuation system 308 to vehicle 302 in blast attenuation environment 300 in FIG. 3. The different operations illustrated in the flowchart may be implemented during various portions of ground vehicle manufacturing and service method 100 in FIG. 1. For example, without limitation, the operations illustrated in the flowchart may be implemented during component and subassembly manufacturing 106, system integration 108, maintenance and service 114, and/or some other portion of ground vehicle manufacturing and service method 100.

The process may begin by positioning blast attenuation system 308 relative to vehicle 302 (operation 1500). Blast attenuation system 308 comprises blast plate 322, internal structure 320, and inner skin 318. Internal structure 320 is capable of absorbing energy 344 applied to the exterior side of blast plate 322. The process then attaches blast attenuation system 308 to vehicle 302 (operation 1502), with the process terminating thereafter.

In the different advantageous embodiments, the positioning and attaching of blast attenuation system 308 to vehicle 302 may involve attaching different components of blast attenuation system 308 in different steps rather than attaching blast attenuation system 308 as a whole to vehicle 302. Further, blast attenuation system 308 or components of blast attenuation system 308 may be attached to vehicle 302 as a part of manufacturing vehicle 302. In these examples, blast attenuation system 308 may be integral to the manufacturing of vehicle 302. In some advantageous embodiments, attachment of blast attenuation system 308 or components of the blast attenuation system 308 to vehicle 302 may be performed as an upgrade or refurbishment of vehicle 302. This upgrade may be performed during, for example, without limitation, maintenance and service 114. In particular, attachment of blast plate 322 may be performed as an upgrade of vehicle 302. Further, in different advantageous embodiments, blast attenuation system 308 may be positioned in other positions rather than under vehicle 302.

Figure 16:
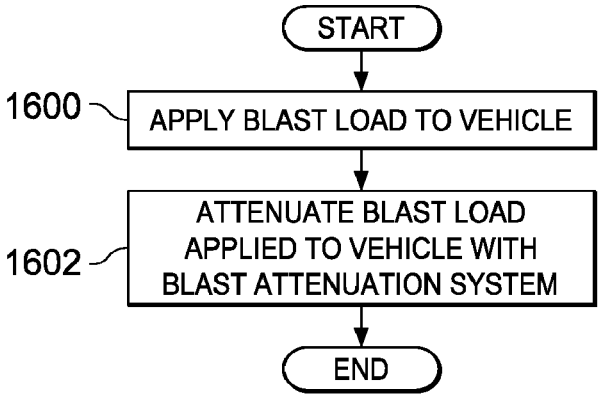
FIG. 16 is an illustration of a flowchart for attenuating a blast load in a vehicle in accordance with an advantageous embodiment.

With reference now to FIG. 16, an illustration of a flowchart for attenuating a blast load in a vehicle is depicted in accordance with an advantageous embodiment. The process illustrated in FIG. 16 may be used to attenuate blast load 310 in vehicle 302 using blast attenuation system 308 in FIG. 3.

The process may begin by applying blast load 310 to vehicle 302 (operation 1600). Blast load 310 may be applied to vehicle 302 using explosive device 312. Explosive device 312 may be an improvised explosive device or a mine, such as a land mine. The process may then attenuate blast load 310 applied to vehicle 302 with blast attenuation system 308 for vehicle 302 (operation 1602). Blast attenuation system comprises blast plate 322 having outer side 325 and inner side 323, internal structure 320 positioned relative to inner side 323, and inner skin 318. Internal structure 320 is capable of absorbing energy 344 and blast load 310 applied to outer side 325 of blast plate 322.

Figure 17:
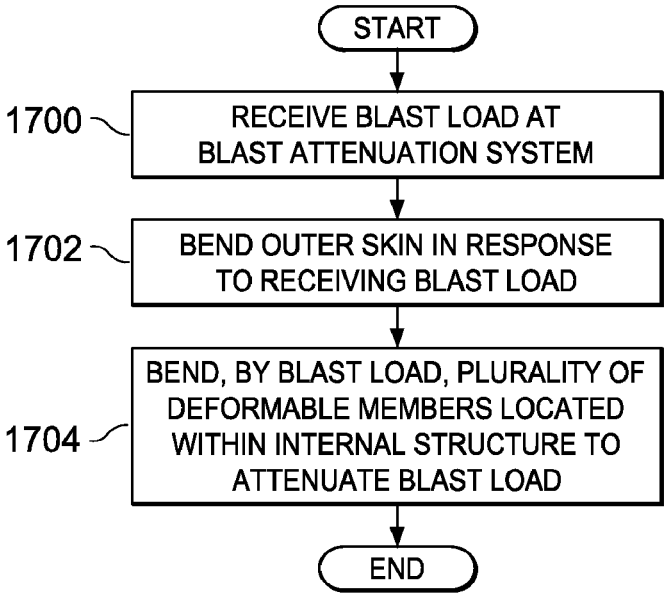
FIG. 17 is an illustration of a flowchart of a process for attenuating a blast load in accordance with an advantageous embodiment.

With reference now to FIG. 17, an illustration of a flowchart for a process for attenuating a blast load is depicted in accordance with an advantageous embodiment. The process illustrated in FIG. 17 may be implemented. The process illustrated in FIG. 16 may be used to attenuate blast load 310 using blast attenuation system 308 in blast attenuation environment 300 in FIG. 3.

The process may begin by receiving blast load 310 at blast attenuation system 308 (operation 1700). Blast load 310 may be applied to blast attenuation system 308 using explosive device 312. In these illustrative examples, blast attenuation system 300 may have outer skin 316, internal structure 320, and inner skin 318. Outer skin 316 may be blast plate 322. Internal structure 320 may be positioned between outer skin 316 and inner skin 318. Further, internal structure 320 may be capable of absorbing blast load 310 applied to outer skin 316. The process may then bend outer skin 316 in response to receiving blast load 310 (operation 1702). Thereafter, plurality of deformable members 330 located within internal structure 320 may be bent by blast load 310 to attenuate blast load 310 (operation 1704), with the process terminating thereafter.

The flowcharts and block diagrams in the different depicted embodiments illustrate the architecture, functionality, and operation of some possible implementations of apparatus and methods in different advantageous embodiments. In this regard, each block in the flowchart or block diagrams may represent a module, segment, function, and/or a portion of an operation or step. In some alternative implementations, the function or functions noted in the block may occur out of the order noted in the figures. For example, in some cases, two blocks shown in succession may be executed substantially concurrently, or the blocks may sometimes be executed in the reverse order, depending upon the functionality involved.

Thus, the different advantageous embodiments provide a method and apparatus for a blast attenuation structure. In the different advantageous embodiments, an apparatus may comprise a blast plate and an internal structure. The internal structure may be positioned relative to an interior side of the blast plate. The internal structure may be capable of absorbing energy applied to an exterior side of the blast plate.

With one or more of the different advantageous embodiments, a blast attenuation system may be implemented that has a lighter weight as compared to currently available blast plates providing the same amount of blast protection. Further, the blast attenuation system in the different advantageous embodiments also may be integrated as part of the frame of the ground vehicle. The different advantageous embodiments may provide a capability to attenuate and/or reduce the load that occurs from a blast in a manner that minimizes and/or eliminates the effects of the load within the vehicle.

The description of the different advantageous embodiments has been presented for purposes of illustration and description, and is not intended to be exhaustive or limited to the embodiments in the form disclosed. Many modifications and variations will be apparent to those of ordinary skill in the art. Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A method for attenuating a blast load in a vehicle, the method comprising:

applying the blast load to the vehicle; and attenuating the blast load applied to the vehicle with a blast attenuation system for the vehicle, wherein the blast attenuation system comprises an apparatus comprising an outer skin comprising an exterior side and an interior side, an internal structure positioned relative to the interior side of the outer skin, such that the internal structure is configured to absorb the blast load applied to the exterior side of the outer skin; and an inner skin, configured as a floor of the vehicle, such that the internal structure is directly connected to the inner skin, wherein the internal structure comprises a plurality of deformable members comprising at least one of a number of longitudinal crushable structures and a number of lateral crushable structures, wherein the number of longitudinal crushable structures comprises a number of longitudinal bulkheads and the number of lateral crushable structures comprises a number of lateral bulkheads.

2. The method of claim 1, wherein the blast load is applied to the vehicle using an explosive device.

3. The method of claim 1, wherein the outer skin comprises:

a blast plate.

4. The method of claim 3, wherein the blast plate has a curved shape.

5. The method of claim 3, such that the blast plate has a number of blast plate buttresses, and such that the blast plate is connected to a frame of the vehicle at the number of blast plate buttresses.

6. The method of claim 3, wherein the blast plate is comprised of a material selected from at least one of a metallic material, aluminum, titanium, steel, a steel alloy, a ceramic material, and a composite material.

7. The method of claim 3 wherein the blast plate is configured such that the blast plate does not resist deformation.

8. The method of claim 1, wherein the internal structure comprises:

a plurality of deformable members, wherein at least some of the plurality of deformable members have a shape selected from one of a curved shape and a double curved shape.

9. The method of claim 8, wherein the plurality of deformable members comprises at least one of a number of longitudinal crushable structures and a number of lateral crushable structures.

10. The method of claim 1, further comprising an energy absorbing floor layer.

11. The method of claim 10 wherein the energy absorbing floor layer comprises at least one of: a crushable material, an elastic material, a honeycomb core, and a foam core.

12. The method of claim 1, such that the inner skin further comprises at least one of: a floor stiffener panel, and an energy absorbing floor layer.

13. The method of claim 1, the internal structure being at least one of: connected to outer skin, comprised of foam, comprised of a honeycomb material, comprised of a crushable shear member, comprising an inner skin stiffener, and comprising an outer skin stiffener.

14. The method of claim 1, such that the inner skin further comprises a deformation inhibiting structure.

15. The method of claim 14, wherein the deformation inhibiting structure comprises at least one of: a honeycomb panel, a foam panel, a stringer, a formed panel, a stiffened panel, a thick plate, and a truss.

16. The method of claim 1 wherein the apparatus is configured such that the apparatus forms a structural component of the vehicle.

17. The method of claim 1 wherein the apparatus is at least one of: attached to, and forming a part of, a frame system of the vehicle.

18. The method of claim 1 wherein the number of lateral bulkheads comprise an opening configured such that a component may pass through at least one of the number of lateral bulkheads.

19. A method for attenuating a blast load in a vehicle, the method comprising:

applying the blast load to the vehicle; and attenuating the blast load applied to the vehicle with a blast attenuation system for the vehicle, wherein the blast attenuation system comprises an apparatus comprising an outer skin comprising an exterior side and an interior side, an internal structure positioned relative to the interior side of the outer skin, such that the internal structure is configured to absorb the blast load applied to the exterior side of the outer skin; and an inner skin, configured as a floor of the vehicle, such that the internal structure is directly connected to the inner skin, wherein the internal structure comprises a plurality of deformable members selected from at least one of a number of bulkheads, a foam material, and a honeycomb material, in which each of the plurality of deformable members has a shape selected from one of a curved shape and a double curved shape; and wherein the inner skin forms the floor of the vehicle, wherein the inner skin comprises at least one of a floor stiffener panel and an energy absorbing floor layer, wherein the internal structure is connected to a frame system of the vehicle.

20. The method of claim 19, wherein the blast load is applied to the vehicle using an explosive device.

* * * * *